US006322000B1

(12) United States Patent
Scarpa et al.

(10) Patent No.: US 6,322,000 B1
(45) Date of Patent: Nov. 27, 2001

(54) CONVERGENT SPRAY NOZZLE SHUT-DOWN SYSTEM

(75) Inventors: Jack G. Scarpa, Huntsville; John D. Marlin, Athens; Terry Hall, Huntsville; Steven A. Cosby, Rogersville, all of AL (US); Jack D. Snyder, Seattle, WA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/394,288

(22) Filed: Sep. 10, 1999

(51) Int. Cl.[7] ..... B05B 15/02

(52) U.S. Cl. ..... 239/112; 239/69; 239/71; 239/419.3; 239/422; 239/424.5; 239/428; 239/434.5

(58) Field of Search ..... 239/124, 106, 239/112, 69, 71, 72, 398, 418, 419, 419.3, 422, 424.5, 428, 433, 434.5

(56) References Cited

U.S. PATENT DOCUMENTS

| | | | |
|---|---|---|---|
| 3,096,225 | | 7/1963 | Carr et al. . |
| 3,185,396 | | 5/1965 | Black . |
| 3,837,575 | | 9/1974 | Lehnert . |
| 4,547,403 | | 10/1985 | Smith . |
| 4,673,594 | | 6/1987 | Smith . |
| 4,750,676 | * | 6/1988 | Huber et al. . |
| 4,760,956 | | 8/1988 | Mansfield . |
| 4,824,017 | | 4/1989 | Mansfield . |
| 4,967,956 | | 11/1990 | Mansfield . |
| 5,044,557 | | 9/1991 | Smith . |
| 5,116,425 | | 5/1992 | Ruef . |
| 5,143,296 | | 9/1992 | Saurwein et al. . |
| 5,307,992 | | 5/1994 | Hall et al. . |
| 5,565,241 | | 10/1996 | Mathias et al. . |
| 5,579,998 | | 12/1996 | Hall et al. . |
| 5,632,817 | * | 5/1997 | Hiraga et al. . |
| 5,645,217 | * | 7/1997 | Warren . |

* cited by examiner

*Primary Examiner*—David A. Scherbel
(74) *Attorney, Agent, or Firm*—Norman Friedland

(57) ABSTRACT

A shut-off system that is semi-automatic or fully automatic shuts off the mechanism for flowing resin, air and filler to a miniaturized convergent spray gun so as to stop the flow of the ingredients of being sprayed and purging the spray gun so that the residue ingredients do not cure and destroy the gun.

6 Claims, 6 Drawing Sheets

CONVERGENT SPRAY NOZZLE SHUT-DOWN SYSTEM

CROSS REFERENCES

This invention relates to the subject matter disclosed in a co-pending patent application contemporaneously filed that is entitled "Portable Convergent Spray Gun Capable of Being Hand-Held" filed by Scarpa et al, commonly assigned to the assignee and identified by Ser. No. 09/394,289, filed Sep. 10, 1999 and is incorporated herein by reference.

TECHNICAL FIELD

This invention relates to portable convergent spray guns for applying coatings to a surface and particularly to a portable spray gun that is miniaturized so as to be capable of being hand-held or having the option of being either hand-held or robotically-held for use with a portable system that includes a shut-down system for purging the spray gun when it is shut-down and the method of accomplishing the same.

BACKGROUND OF THE INVENTION

U.S. Pat. No. 5,565,241 granted to Mathias et al on Oct. 15, 1996 entitled "Convergent End Effector", U.S. Pat. No. 5,307,992 granted to Hall et al on May 3, 1994 entitled "Method And System For Coating A Substrate With A Reinforced Resin Matrix" and U.S. Pat. No. 5,579,998 granted to Hall et al on Dec. 3, 1996 entitled "Method For Coating A Substrate With A Reinforced Resin Matrix" of which the inventor Jack G. Scarpa is a co-inventor and which these patents are commonly assigned. These references disclose a spray gun that utilizes a nozzle that is designed to configure the spray emitted by the nozzle into an atomized convergent plume of liquid resin and targets the plume with reinforced filler material immediately downstream of the nozzle to mix and wet the filler just prior to being applied to the surface of the substrate. In other words, the reinforcing material is entrained around the atomized liquid resin flow and is caused to be captured thereby, mix therewith and become an homogeneously wetted coating material that after impact with the substrates becomes cured into a substantially reasonably thick coating exhibiting good strength and resistance characteristics. The gaseous transport stream together with the eductor deliver the ingredients in the proper proportions and the air stream for causing the atomization and mixing to provide the proper amounts of material to assure that the coating is uniform and consistent. Heating is applied in the proper sequence to assure that the viscosity is at the proper level to assure evenness of flow.

As one skilled in this technology would appreciate, the heretofore known spray application equipment for spraying of highly loaded paints and coatings which require the addition of a high volume of solid large granular materials such as cork, glass micro spheres, granular or powdered materials in the 3 to 300 microns range require large amounts of solvents to dilute solid contents down to a level where it can be sprayed effectively. This, of necessity, requires special spray equipment designs that need to be significantly large in order to effectively spray these materials. Such systems have heretofore been designed to operate in a room or compartment that include a robot that was programmed to hold the spray gun and apply the spray. An additional room houses the supply of materials to be mixed and sprayed, the various valves, hoppers, proportioning devices and the like are separated from the spray gun room and a separate room housed the computer equipment and controls that served to control the various valves, proportioning devices etc, to automatically effectuate the spraying.

These special very large spray equipment designs leads to very low actual transfer efficiencies for spraying these coating materials. These low transfer efficiencies have a significant impact on the quantities of materials, solvents and volatile organic compounds that are released into the environment. As one skilled in this technology will appreciate, from an ecology standpoint these conditions are not preferred as is recognized by the Environmental protection Agency and Occupational Safety and Health Administrations that are tightening regulations that mandate change.

While the sized the gun of this invention retains all of the features of the heretofore known convergent spray gun utilizing the end-effector, this spray gun is capable of supplying the same amount of coating for each pass of these heretofore known spray guns. This spray gun is characterized as being portable and capable of being held by one hand in the same way that a commercially available paint spray gun is handled. In this mechanism concentric tube assembly is added to a modified commercially available spray nozzle, such as spray nozzles produced by Binks, Franklin Park, Ill and Grace, Detroit, Mich. that provides an inner tube that transports the resin and an outer tube that transports the air for atomizing the mixture and the dry powdered nozzle and its convergent cap. This arrangement of the concentric tubes allows the dry powdered nozzle that transports the dry powder material into a manifold to be propelled into the resin/air atomization plume. The dry granular materials and atomized resins become entrained at this point and thoroughly mix together outside the gun before being deposited on the substrate.

This patent application constitutes an improvement over the structure described in the U.S. Pat. Nos. 5,5645,241, supra 5,307,992, supra and 5,579,998. Essentially these patents are designed in a closed room environment where the spraying is done in a separate room from where the controls and ingredients are held and the spray gun is held by a robot so that the size and weight are not critical. As a matter of fact, the heretofore known designs of the convergent type of spray gun described above is much too heavy to be hand operated.

This invention is directed to a portable system where all of the controls, computers, valves, hoppers, eductors, proportioners and ingredients are contained in a portable cart and a hand-held spray gun is utilized with this system. Obviously, making the system portable increases the flexibility of the system and permits use of the system in different areas and locations. While the heretofore known systems include mechanism for purging the spray gun, this is not a particular concern where the system is in place and non-portable. Because of the portability of the system a more positive shut-off system was required to assure that the resin didn't remain in the gun and become hardened over a period of time when the spray gun was not in use. This invention provides a positive shut down system that shuts the system down when the spray gun is turned off. A back-up alarm system is utilized to warn the user that the gun has not been purged after a given period of time.

SUMMARY OF THE INVENTION

An object of this invention is to provide a shut-down system for a portable convergent type of spray gun of the type that includes an end-effector.

A feature of this invention is to provide on the handle of the spray gun a proximity switch that is actuated when the handle is placed in a predetermined position to relay a signal to provide a proper sequence of shut-down of the system.

The shut down system of this invention is characterized as being easy to fabricate, simple in design, relatively inexpensive and reliable.

The foregoing and other features of the present invention will become more apparent from the following description and accompanying drawings.

DETAILED DESCRIPTION OF THE INVENTION

To better understand this invention the nomenclature of the component parts are defined as follows:

Convergent End Effector nozzle—is the discharge end of the gun where the resin and air are atomized and converged and the dry powder is introduced through the dry powdered nozzle.

Dry powdered nozzle is the nozzle that feeds the dry powder into the plume of the atomized resin.

Convergent cap is the cap mounted on the end of the dry powdered nozzle that defines the discharge orifice.

Nozzle is any discharge orifice that discharges flow in a prescribed manner.

Figure 1:
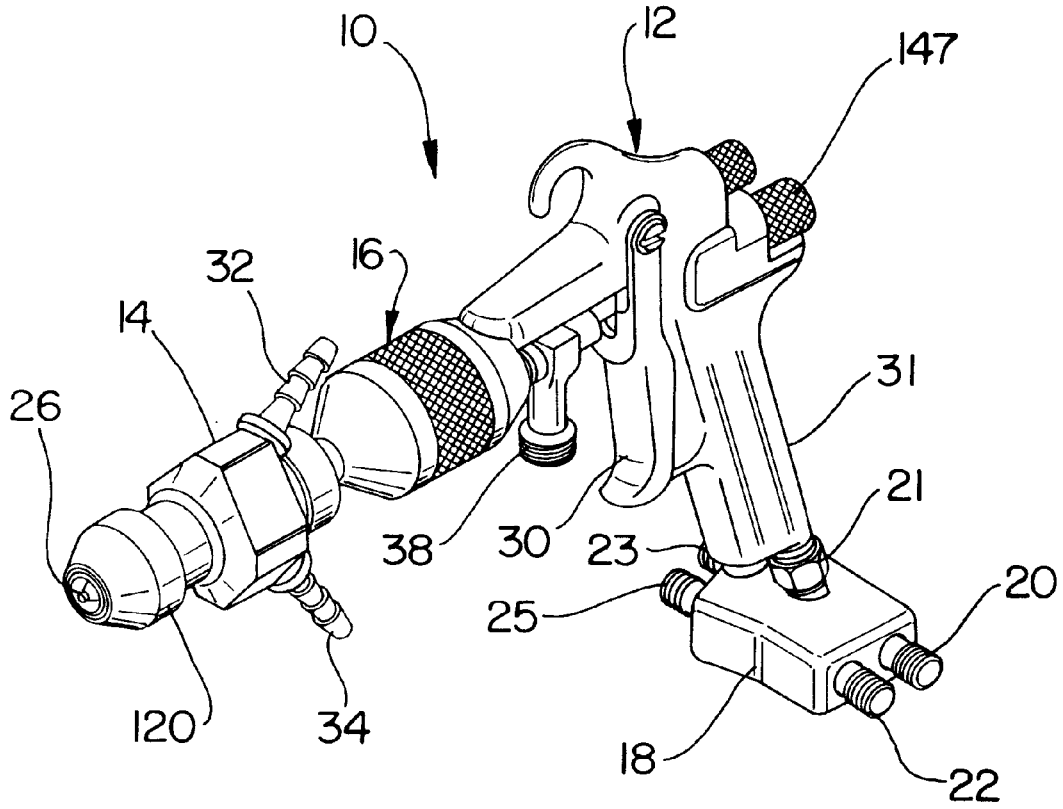
FIG. 1 is a perspective view of the miniaturized spray gun of this invention.
Figure 2:
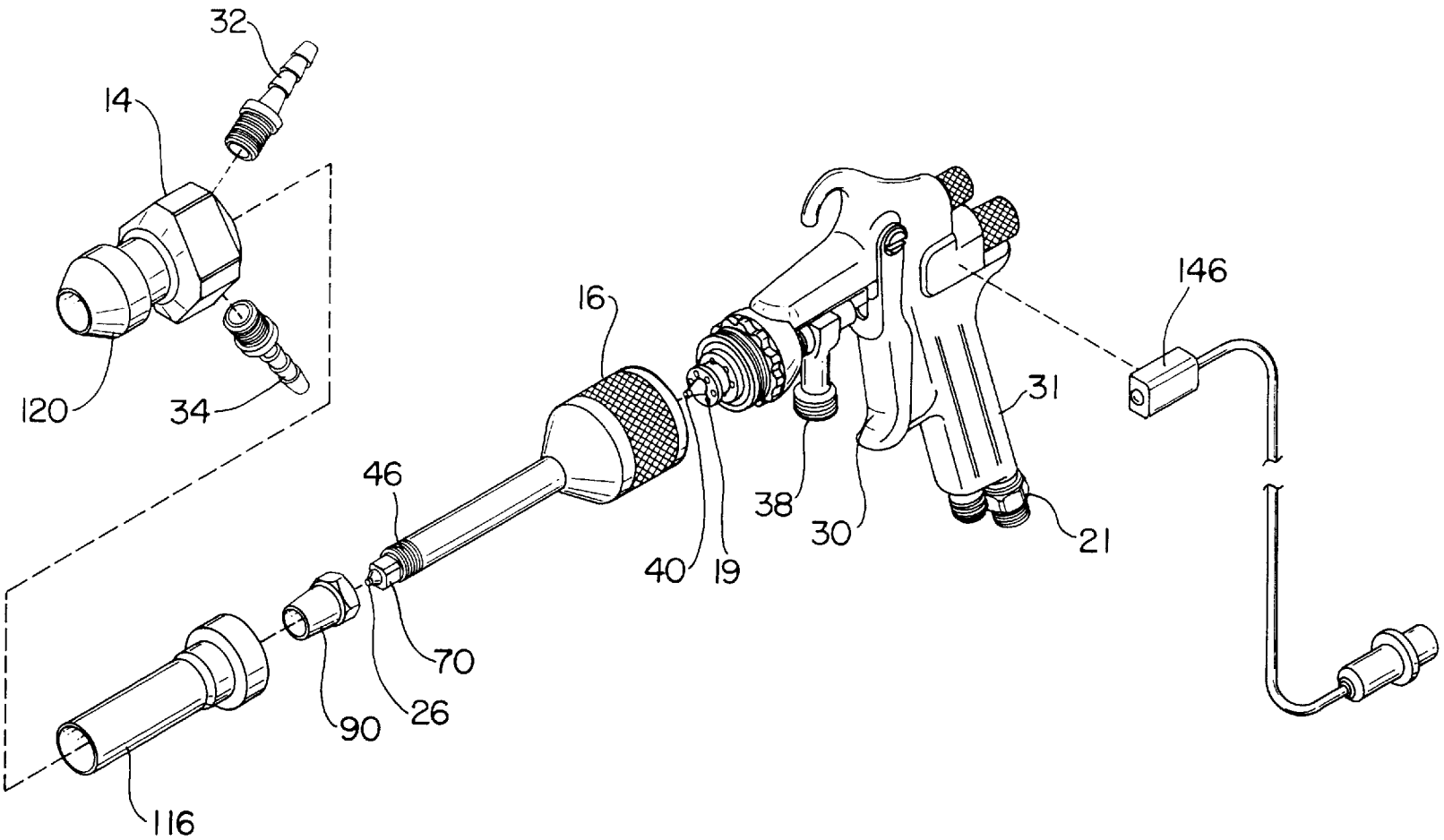
FIG. 2 is an exploded view showing the component parts of the invention comprising the miniaturized convergent spray gun of FIG. 1.
Figure 3:
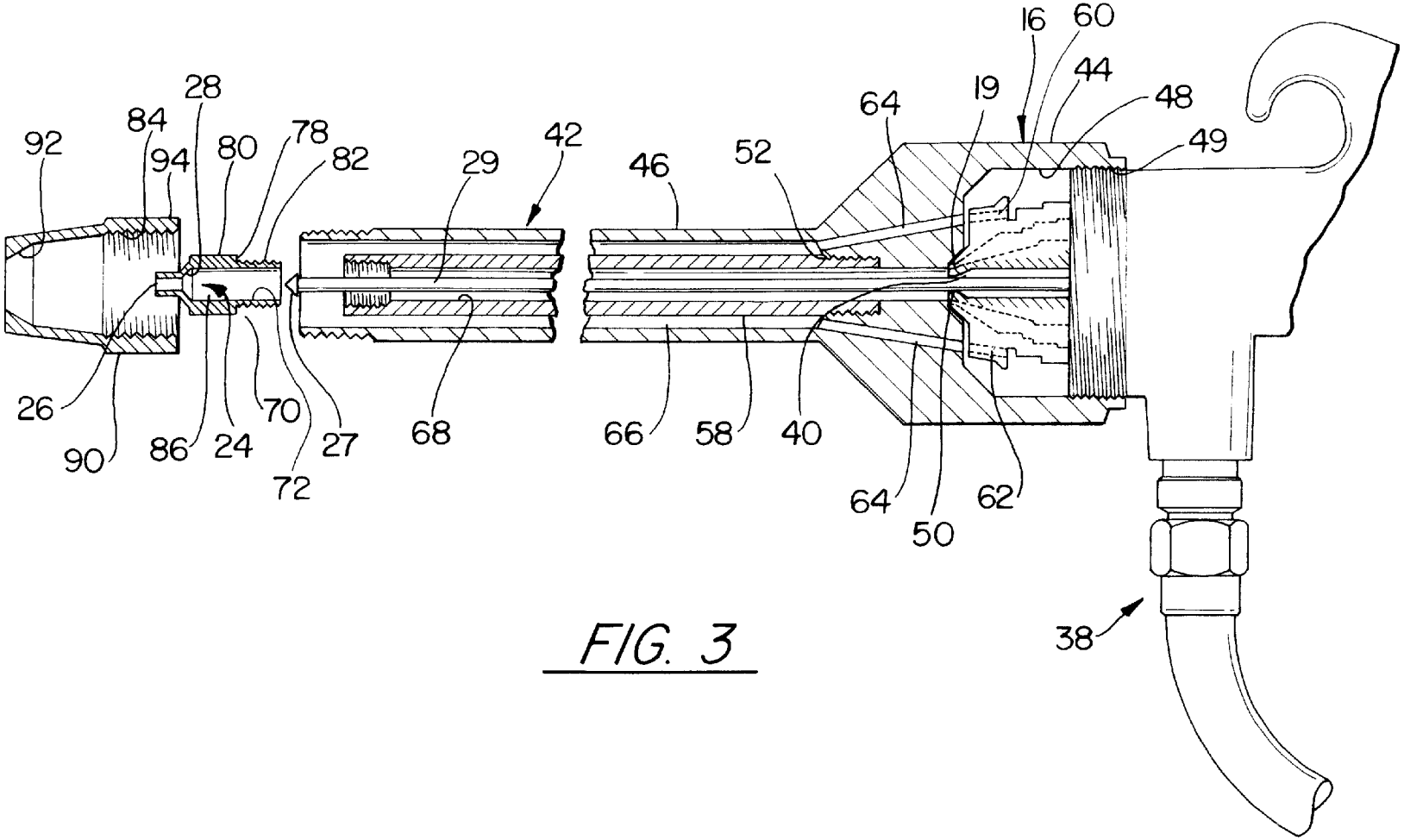
FIG. 3 is a diagrammatic view in section of the concentric tube assembly of this invention.

The invention can best be understood by referring to FIGS. 1–7 which shows the convergent spray gun generally illustrated by reference numeral 10 as being comprised of a commercially available Binks gun or of the type of gun described in U.S. Pat. No. 2,971,700 granted to Peeps on Feb. 14, 1961 entitled "Apparatus For Coating Articles With Chemically Reactive Liquids" (which is incorporated herein by reference) generally illustrated by reference numeral 12 and modified for meeting the requirements of this invention, the dry powered nozzle 14 and the concentric tube assembly generally illustrated by reference numeral 16. The commercially available Binks gun is modified to accommodate this invention by including a receiving box 18 that includes fittings for transmitting air into inlet 20 and then into the inlet 21 of the spray gun 10, fittings for transmitting the dry powder into inlet 22 where it is split by any type of splitter (not shown) into two streams for flowing the dry powder through the discharge fittings 23 and 25 and the valve 24 (see FIG. 3). Trigger 30 is suitably mounted adjacent the handle 31 and is conveniently available for operation for actuating the gun to turn the spray of coating on and off. The fitting 38 serves to receive the mixed resin delivered thereto from a suitable pressurized source and flows through a passage formed in the spray gun 10 and discharges though the central orifice 26 as will be described in detail hereinbelow. In addition to the modification of the Binks gun described above, a fluid tip of the type known as a Paasche that is commercially available and as best seen in FIG. 3 is designed to include valve 24 that is manually operated by the trigger 30. Valve 24 is located adjacent to the central orifice 26 discharging the resin and includes seat 28 surrounding the orifice 26 and the valve body 27 connected to the valve stem 29 for rectilinearly movement by actuation of the trigger 30 for opening and closing the discharge orifice 26 of the spray gun 10. Optionally, the valve 24 can be located at the nozzle 40 (FIG.3).

Figure 4:
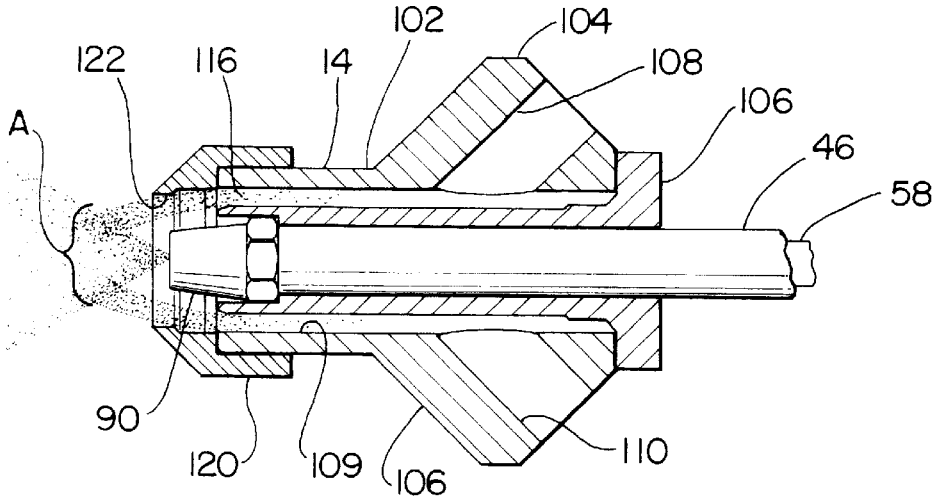
FIG. 4 is a partial view partly in section and partly in elevation taken along the longitudinal axis of the concentric tubes of FIG. 1.
Figure 5:
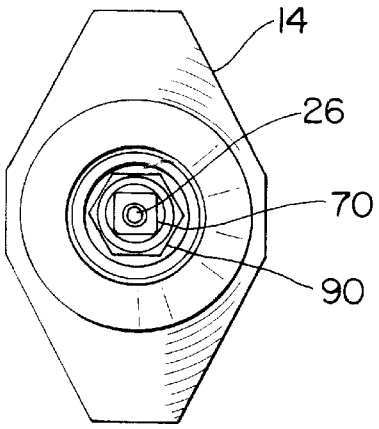
FIG. 5 is plan view of the front end of the dry powdered nozzle of the spray gun depicted in FIG. 1.
Figure 6:
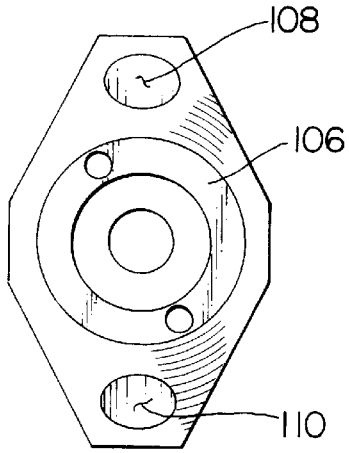
FIG. 6 is a plan view of the aft end of the dry powdered nozzle of the spray gun depicted in FIG. 1.

Referring next to FIGS. 4–6, the dry powdered nozzle 14 mounted on the concentric tube assembly 16 includes a pair of diametrically opposed fittings 32 and 34 adapted to receive suitable tubing for conveying the dry powder flowing through the fittings into the manifold of the dry powered nozzle that will be described hereinbelow.

As was mentioned above, the spray gun 10 is capable of being miniaturized from the heretofore known convergent spray guns not merely because the components are made smaller, which is partially the case, but because of the modification to the Binks type of gun and the addition of the inner and outer extension tubes of the concentric tube assembly 16 which will be described in more detail hereinbelow. As best seen in FIG. 3, the modified Binks gun 12 includes the central orifice 40 that is fluidly connected to the inlet of the fitting 38 for flowing the resin toward the discharge end of the spray gun. The outer tube 42 includes a large diameter hollow conically shaped portion 44 that fairs into a smaller diameter tubular portion 46 that extends axially toward the fore end of the spray gun. The aft end of the outer tube 42 is threadably connected to the end of the modified Binks gun by the complementary threads 49 so that the cavity 48 defined by the conically shaped large diameter portion 44 surrounds the tip 50 of the modified Binks gun. Inner tubular member 58 is threadably attached to the outer tube 44 by the complementary threads 52 and, like the tubular portion 46 of the outer tube 42, extends axially toward the tip of the spray gun 10 and lines up with orifice 40 to continue the flow or resin toward the central discharge orifice 26. As is apparent from the foregoing the resin is transported toward the tip of the spray gun 10 through the inner tubular member 58 and atomizing air discharging from the circumferentially spaced air discharge holes 60 and 62 of the Binks gun is transported through the outer tubular member 42 via the centrally disposed drilled passages 64 and the annular passage 66. The tip of the spray gun 10 is defined by the fluid tip element 70 that includes a central passage 72 terminating in a discharge central orifice 26 and the air cap 90 (the air cap may be a commercially available air cap of the Paasche type), both of which serve to create a conically shaped convergent plume A (see FIG. 4) at the exterior thereof. The fluid tip element 70 includes a main body 78 which is circular in cross section and is dimensioned so that its diameter is substantially equal to the inner diameter of the tubular portion 46 and several (up to four) segments or secants to the circular cross section are milled or cut at the larger diameter portion 80 to form flats that leave a gap between the fluid tip element 70 and the annular passage 66 (See FIG. 3). This meters and directs and atomizes the air in the annular passage 66. As can best be seen in FIG. 3, the aft end 82 of the fluid tip element 70 extends axially rearwardly and is threaded to complement the threads formed on the end of the inner tubular member 58 to form a tight fit and communicate the central orifice 84 with the passage 86 formed in the fluid tip element 70 which, in turn, communicates with the passage 68 of the inner tubular member 58 for flowing resin through central orifice 84.

Air cap 90 includes a conical inner surface 92 and a threaded aft end 94 that threadably engages the complementary threads formed on the outer end of the outer tubular member 46 and serves to surround the fluid tip element 70. The air cap 90 serves to converge the atomized air toward the discharge end of central orifice 84 so that the resin flowing through passage 68 into the reduced diameter portion of central passage 86 to increase the dynamic head of the resin and cause it to be accelerated and expand as it is being discharged. The air discharging from the convergent surface 92 of air cap is formed in a highly atomized spray that mixes intensely with the resin as it discharges from orifice 84 and forms a stream of small particles accelerating toward the target. The mixed atomized air and resin are discharged so as to define a plume immediately downstream of the central aperture 26 formed in the air cap 90 where the dry powder is injected as will be explained hereinbelow.

The dry powdered nozzle 14 as shown in FIGS. 4–6 consists of a main cylindrically shaped body 102 having angularly disposed extension portions 104 and 106 and includes a central straight through bore 109 communicating with the drilled passages 108 and 110 angularly disposed relative thereto formed in the extension portions 104 and 106, respectively. The dry powdered nozzle 14 is fitted over the sleeve 116 that is concentrically and coaxially disposed relative to the fluid tip 70 and the tubular member 46 and tubular member 58 of the concentric tube assembly 16. Convergent cap 120 is frictionally fitted or fitted in any suitable manner at the aft end of the dry powdered nozzle cap 14 and includes a nozzle 122 defined by the convergent cap 120 that contains the flow of dry powder from the dry powdered nozzle 14 into the plume A ( as shown in FIG. 4). The annular space between the sleeve 106 and the inner diameter of the main body 102 of the dry powdered nozzle 14 define an annular manifold 116 where the powder is transmitted and streamlined just prior to being injected into the low pressure area caused by the atomized plume A (FIG. 4). These elements just described, namely the air cap 90, fluid tip 70 and dry powdered nozzle 14, form the end-effector of the convergent spray gun. While the end-effector of the present invention functions similarly to the end-effector shown in U.S. Pat. No. 5,307,992, supra, because of the incorporation of the concentric tube assembly 16, the dry powdered nozzle 14 and convergent cap 120 is made significantly smaller than the heretofore designs while at the same time being comparable to the volume of flow of the ingredients emitted at the discharge end of the spray gun.

Figure 6A:
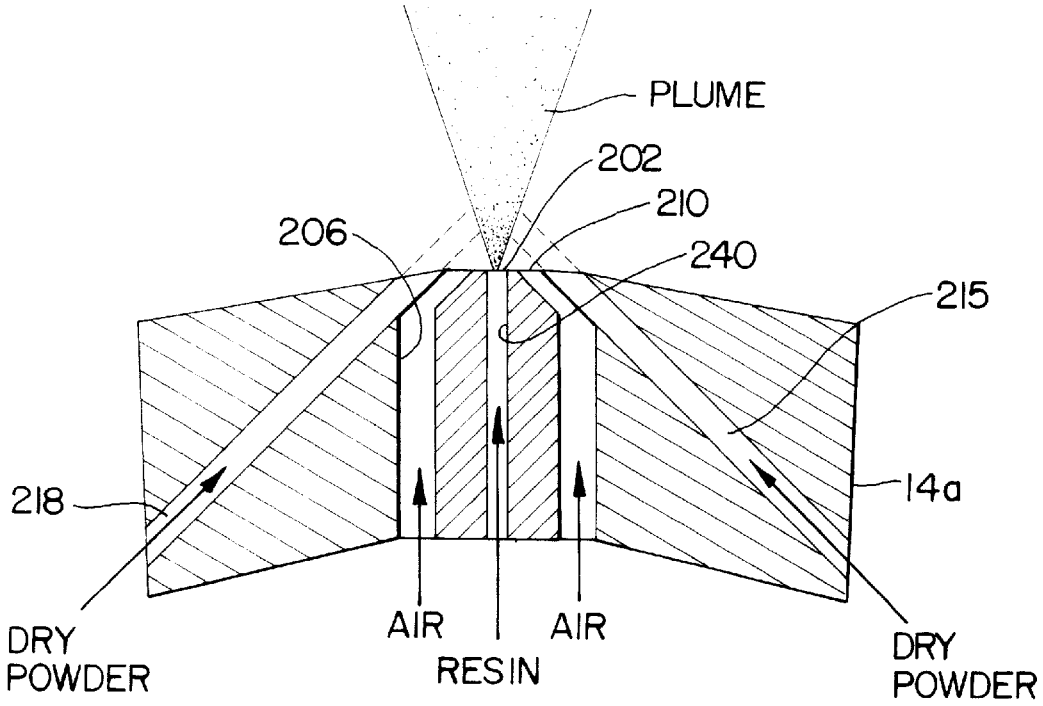
FIG. 6A is a is a sectional view of an alternate embodiment of the dry powdered nozzle for use with the spray gun depicted in FIG. 1.

FIG. 6A exemplifies another embodiment of the dry powdered nozzle 14*a* that includes the central passage 240 (the same reference numeral with a subscript is used to depict similar parts in all the Figures) for flowing the liquid resin that discharges through central orifice 202, the annular air passages 206 that discharge the air through the annular orifice 210 at an angle to converge with and atomize the resin and the diametrically opposed dry powdered passages 215 and 218 that directly feed into the low pressure zone of the plume of the atomized air/resin stream. It will be appreciated that the a configuration of the dry powdered nozzle 14 depicted in FIGS. 5 and 6 is designed to accommodate the larger granular sized particles of dry powder, while the dry powdered nozzle 14*a* depicted in FIG. 6A is preferably designed for a finer dry powder granular.

Figure 7:
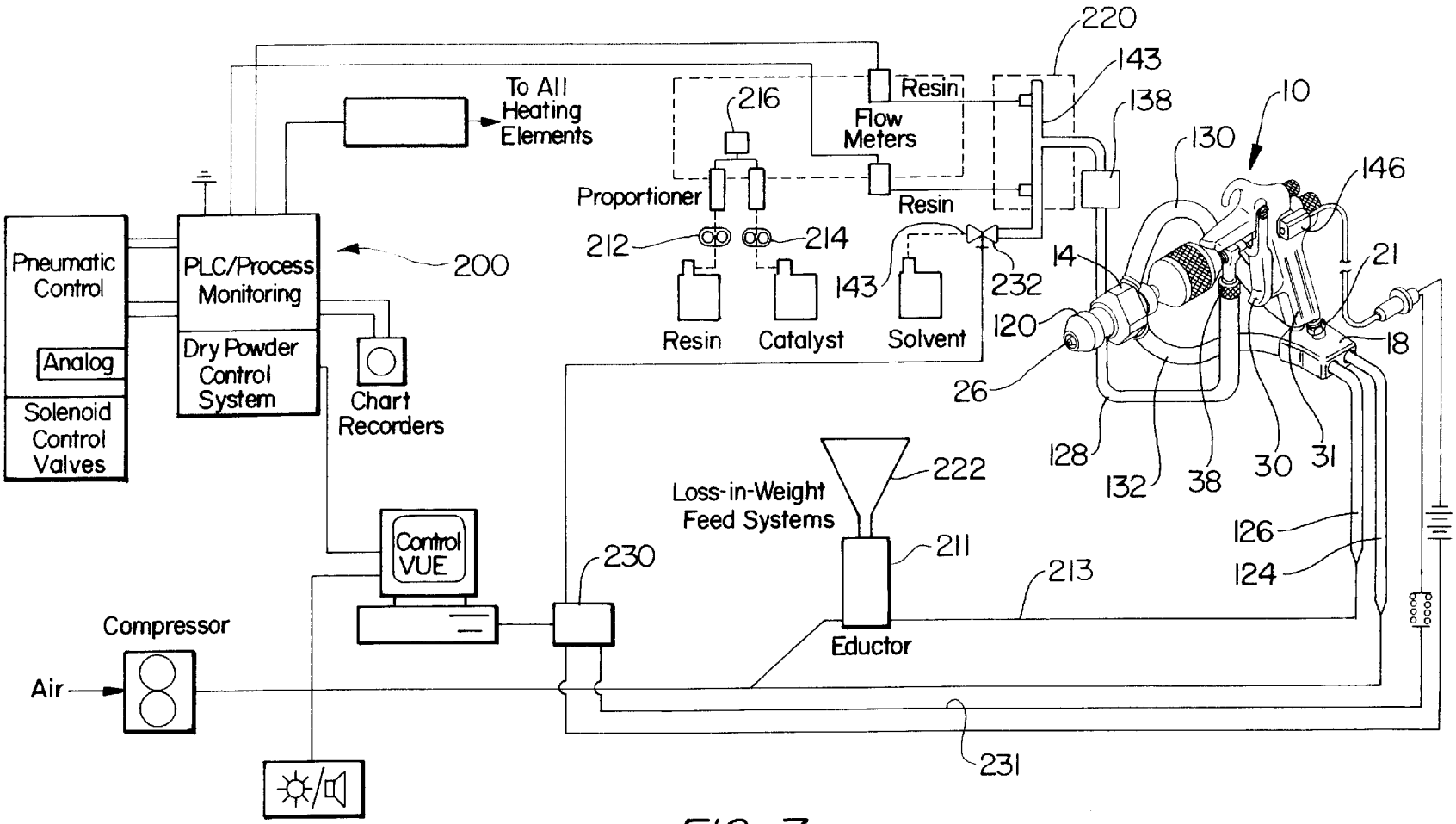
FIG. 7 is a perspective view of the spray gun depicted in FIG. 1 and a schematic illustration of the system utilized therewith; and These figures merely serve to further clarify and illustrate the present invention and are not intended to limit the scope thereof.

In operation, and as seen in FIG. 7, the system for supplying the materials to the spray gun 10 consists of a standard PC computer 200 and process control software that operates and controls monitors, the various valves, proportioner, eductor, resin and catalyst pumps. Preferably, the components of the system are mounted on a portable cart for providing a portable coating apparatus including the hand-held gun that can be utilized without the requirement of fixed rooms and/or compartments. As best seen in FIG. 7, the computer controls the various solenoid control valves, the pneumatic control, the dry powder control system, the PLC/Process Monitoring, and heating of the materials, when or if needed. Actuation of the system turns on the compressor for feeding air to the eductor 211, the resin pump 212 and the catalyst pump 214. The pump and flow meters coupled with the process control software controls resin flow ratio and will also monitor the system for performance.

As is apparent from the foregoing, the resin and catalyst is fed to the manifold 220 where they are combined and fed to the mixer, which may be any well known static or dynamic type, where it is mixed and fed to the gun 10 via hose 128. The dry powder, such as cork or glass micro spheres contained in the dry hopper 222, which is a loss-in-weight or mass loss feeding system is transported to the spray gun 10 via the eductor pneumatic tubes 213, hose 126, the receiving box 18, and then, hoses 130 and 132. High pressure air is fed directly to spray gun 10 via the hose 124, receiving box 18 and inlet 21. The coating material is emitted from the spray gun 10 by releasing and depressing trigger 30 of spray gun 10. In accordance with this invention, the shut down system for purging the spray gun 10 is activated by releasing trigger 30. Proximity switch 146, which is commercially available from Pepperl+Fuchs Inc. of Twinsburg, Ohio, generates a milliampere signal when the trigger comes into close proximity with the proximity switch 146, which, in turn relays a signal to the computer via the control 230. The computer includes a time delay that activates either an electric light bulb or noise generator to warn the operator that the resin will harden if left in the gun. A manual operated control valve 232 opens the connecting line 143 to flow of a suitable solvent via the manifold 220 into the mixer 138 and then, the spray gun 10 for purging the lines. It is apparent from the foregoing that the valve 232 can be made to operate automatically upon receiving a signal from the proximity switch 146 as shown by the line 231 which would send a signal directly to an actuator for automatically turning the valve while the computer has relayed signals to the system for ceasing flow of the ingredients to the gun. The saline solution for purging the spray gun is at sufficient pressure to force the valve 24 to open so that the captured resin is discharged through the nozzle as the saline solution flows therethrough.

The use of the proximity switch 146 which is mounted on the handle 31 in close proximity to the trigger 30 is a simple, inexpensive, yet efficacious manner for initiating control 230.

Although this invention has been shown and described with respect to detailed embodiments thereof, it will be appreciated and understood by those skilled in the art that various changes in form and detail thereof may be made without departing from the spirit and scope of the claimed invention.

We claim:

1. A miniaturized convergent spray gun for applying a coating to a substrate which coating includes an ingredient that cures over time and a computerized system for monitoring and controlling a flow of ingredients to said spray gun, said spray gun including a handle and trigger pivotally mounted on said handle for activating the flow of ingredients through said spray gun, said spray gun including a central passage, a discharge nozzle for discharging said ingredient from said central passage, a reservoir for storing a purging solution, a flow passage interconnecting said reservoir and said central passage, a normally closed valve for preventing the flow of said purging solution connected to said flow passage, a proximity switch attached to said handle and operatively connected to said trigger so that when said trigger is released, a signal is transmitted from the proximity switch to a control for imputing a signal to said computerized system for actuating a computer to stop the flow of ingredients to the spray gun and to produce an audio or visual signal to indicate that said spray gun is deactivated and said valve being manually operable to open said flow passage to flow the purging solution from said reservoir to said discharge nozzle.

2. A miniaturized convergent spray gun for applying a coating to a substrate which coating includes an ingredient that cures over time and a computerized system for monitoring and controlling the flow of ingredients to said spray gun as claimed in claim 1 wherein said ingredient is a resin and a catalyst, a mixer for mixing said resin and catalyst mounted upstream from said spray gun, a conduit interconnecting said mixer and said spray gun, said flow passage being fluidly connected to said conduit for flowing said purging solution from said reservoir through said flow passage and a portion of said conduit into said spray gun.

3. A miniaturized convergent spray gun for applying a coating to a substrate which coating includes an ingredient that cures over time and a computerized system for monitoring and controlling the flow of ingredients to said spray gun as claimed in claim 2 including an electrical system operatively connected to said proximity switch for producing a milliampere signal that is operatively connected to said control.

4. A miniaturized convergent spray gun for applying a coating to a substrate which coating includes an ingredient that cures over time and a computerized system for monitoring and controlling the flow of ingredients to said spray gun, said spray gun including a handle and trigger pivotally mounted on said handle for activating the flow of ingredients through said spray gun, said spray gun including a central passage, a discharge nozzle for discharging said ingredient from said central passage, a purging system including a reservoir for storing a purging solution, a flow passage interconnecting said reservoir and said central passage, a normally closed valve for preventing the flow of said purging solution connected to said flow passage, a proximity switch attached to said handle and operatively connected to said trigger, a control for relaying a signal to said computerized system, a signal generated by said proximity switch when said trigger is released being transmitted to said control for imputing a signal to said computerized system for actuating a computer to stop the flow of ingredients to said spray gun and activate said purging system for opening said normally closed valve delivering said purging solution from said reservoir through said flow passage to said central passage and said nozzle whereby said ingredient is removed from said spray gun.

5. A miniaturized convergent spray gun for applying a coating to a substrate which coating includes an ingredient that cures over time and a computerized system for monitoring and controlling the flow of ingredients to said spray gun as claimed in claim 4 wherein said ingredient is a resin and a catalyst, a mixer for mixing said resin and catalyst mounted upstream from said spray gun, a conduit interconnecting said mixer and said spray gun, said flow passage being fluidly connected to said conduit for flowing said purging solution from said reservoir through said flow passage and a portion of said conduit into said spray gun.

6. A miniaturized convergent spray gun for applying a coating to a substrate which coating includes an ingredient that cures over time and a computerized system for monitoring and controlling the flow of ingredients to said spray gun as claimed in claim 5 including an electrical system operatively connected to said proximity switch for producing a milliampere signal that is operatively connected to said control.

* * * * *